US005211347A

United States Patent [19]

Riva

[11] Patent Number: 5,211,347

[45] Date of Patent: May 18, 1993

[54] THREAD FEED DEVICE

[75] Inventor: Ermete Riva, Pagnana Di Merate, Italy

[73] Assignee: Sobrevin Société de brevets industriels-Etablissement, Vaduz, Liechtenstein

[21] Appl. No.: 715,822

[22] Filed: Jun. 14, 1991

[30] Foreign Application Priority Data

| | | | |
|---|---|---|---|
| Jun. 29, 1990 | [DE] | Fed. Rep. of Germany | 4020642 |
| Dec. 28, 1990 | [DE] | Fed. Rep. of Germany | 4042076 |
| Jan. 28, 1991 | [DE] | Fed. Rep. of Germany | 4102440 |
| Feb. 25, 1991 | [DE] | Fed. Rep. of Germany | 4105889 |
| Mar. 14, 1991 | [DE] | Fed. Rep. of Germany | 4108238 |

[51] Int. Cl.[5] ..... B65H 51/20

[52] U.S. Cl. ..... 242/47.01

[58] Field of Search ..... 242/47.01, 47.04, 47.05, 242/47.06, 47.07, 47.12, 47.13, 47; 66/132 R, 132 T; 139/452

[56] References Cited

U.S. PATENT DOCUMENTS

| | | | |
|---|---|---|---|
| 3,796,386 | 3/1974 | Tannert | 242/47.01 X |
| 4,298,172 | 11/1981 | Hellstrom | 242/47.01 |
| 4,653,701 | 3/1987 | Riva | 242/47.01 |
| 4,676,442 | 6/1987 | Tholander et al. | 242/47.01 |
| 4,687,149 | 8/1987 | Riva | 242/47.01 |

FOREIGN PATENT DOCUMENTS

| | | |
|---|---|---|
| 0192851 | 12/1985 | European Pat. Off. . |
| 0174039 | 3/1986 | European Pat. Off. . |
| 0244511 | 11/1987 | European Pat. Off. . |
| 1809091 | 6/1970 | Fed. Rep. of Germany . |
| 1785508 | 4/1971 | Fed. Rep. of Germany . |
| 2849388 | 2/1983 | Fed. Rep. of Germany . |
| 2239882 | 2/1975 | France . |
| 2267684 | 11/1975 | France . |
| 8304056 | 11/1983 | PCT Int'l Appl. . |

*Primary Examiner*—Stanley N. Gilreath
*Attorney, Agent, or Firm*—Martin A. Farber

[57] ABSTRACT

A thread feed device having a storage body to which the thread is fed at one end in circumferential direction, and from which the thread is drawin off in axial direction (overhead), and with which there is associated a scanning device. A signal of the scanning device controls the thread winding speed. A swing arm bears a sensor part of the scanning device, said sensor part cooperating without contact with a stationary sensor part. In all positions of the swing arm, signals received from the stationary sensor part, starting from the depositing of the first thread turns on the swing arm, controls a reduction in the thread-winding speed, which speed decreases to a minimum value in a manner, corresponding to the increasing coverage of the length of the swing arm by turns of thread.

33 Claims, 8 Drawing Sheets 13
2
F
6
72
72
5
71
4
1
7
A
3

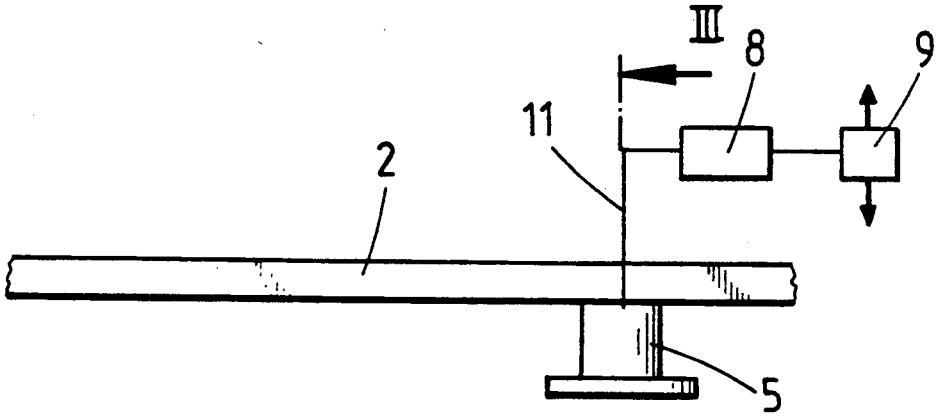
Fig. 2
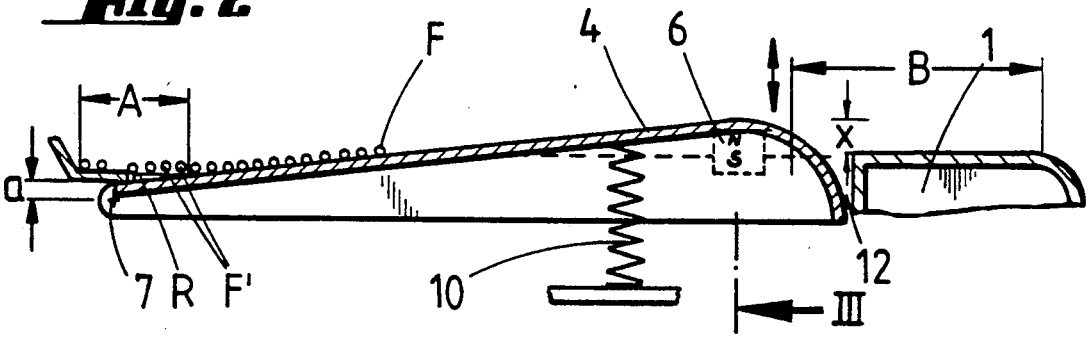
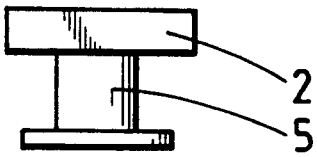
Fig. 3
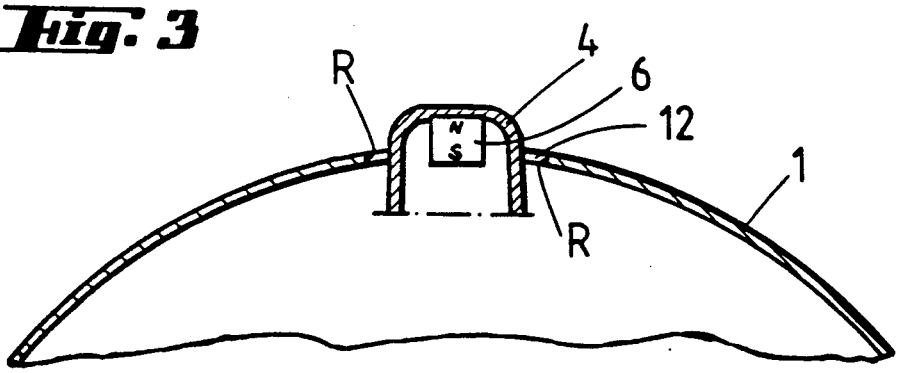

THREAD FEED DEVICE

FIELD AND BACKGROUND OF THE INVENTION

The present invention refers to a thread feed device. Such devices (German OS-17 85 508, FIG. 13) operate in accordance with the stop and go system: when the maximum amount of thread is stored, the one sensor part has moved so far towards the other that the thread winding speed goes to "stop". If the amount of thread stored reaches a minimum value due to the consumption of thread, then the sensors produce a signal which brings the rotary drive motor again into action. Two opposite swing arms coupled to the one sensor part are provided. They extend into slots in an axially displaceable sleeve which extends only over a part of the length of the storage body and of the swing arms. The swing arms extend within the region of the thread feed plane with a bent end into the inside of the storage body where they are supported in such a manner that in the switch position of the sensors they extend parallel to the outer surface of the storage body. This means that the swing arms and the sensor borne by them move differently upon the filling of the thread supply than upon the reduction of the thread supply: the swing arms, which are shifted continuously into the parallel position upon the filling, are held in the parallel position by the thread windings which are then wound closer and pushed forward until practically all thread windings have been withdrawn. Furthermore, the continuous alternation between maximum speed of rotation and stop is disadvantageous. It limits the thread passage capacity, increases the wear and imparts the greatest negative influence to the moment of inertia of the rotary drive.

In order to avoid some of these disadvantages, it is known, instead of the pure stop and go system, to develop the scanning means as a two-point control which operates with intermediate speed steps. One of these solutions (German OS 18 09 091) provides a light-barrier ledge in the storage body which gives off a switch signal in the case of maximum and minimum thread supply, with the result that the winding speed is reduced or increased respectively. After a certain period of oscillation, taking into account also the inertia of the rotary drive, this results in the thread feed continuously approaching the average speed of withdrawal of the thread in such a manner that the amount of thread storage extends up to the middle region between the maximum and minimum switch points, remaining approximately constant for large periods of time. Changes in the thread draw-off speed which take place are then, however, always also only recorded after the thread storage amount has already changed up to the one or other switch point. This limits the maximum possible capacity of such a device. In another two-point control with intermediate speed steps (German Patent 28 49 388), the drive signal which corresponds to the middle region between the switch points is stored when the maximum or minimum switch point has been reached by the thread supply and a progressive correction of this drive signal in upward or downward direction is effected for the duration of the stay of the thread storage amount in the upper or lower switch region, so that therefore there is a correction as a function of the period of time during which the thread storage quantity actuates the maximum or the minimum region switch. The said region switches are in this case structurally actuated by a sensor part which is moved back and forth between two fixed sensor parts by a ring; the ring is displaced against swing force by the thread turn which lies in each case furthest to the front. This two-point control which is dependent on the time of stay is cumbersome from a standpoint of control technique and furthermore cannot handle highest speeds in particular because, in order to form a speed-regulating correction signal, it requires, first of all, a travel of the thread supply up to the upper or lower switch point. Furthermore, the scanning of the frontmost thread turn which is to be drawn off is disadvantageous; the thread draw-off point which moves around the storage body upon the drawing off of the thread is clamped between the spring-loaded ring and the next to the last turn of thread. Furthermore, the thread turns must lie closely against each other; the device cannot operate with thread turns which are spaced apart. It has been found that with higher speeds of thread removal, the correction time span, particularly at the minimum switch point, may not be sufficient to form the acceleration signal so that the storage body is completely emptied.

Finally, it is also known (EP 0 192 851) to develop the scanning means in such a manner that a control of the speed of the rotary drive takes place in a manner analogous to the stored amount of thread supply. For this purpose, light-barrier ledges are provided which extend at least over the storage length of the storage body, the intensity of the light being evaluated in order to form the speed-control signals: the greater the length of the light-barrier ledge which is covered by the supply of thread is, the smaller the thread supply and a corresponding increase in the speed of the rotary drive takes place. These solutions have the disadvantage that they are relatively sensitive to stray light and dust and are dependent on the translucence of the yarn used. Furthermore, these solutions do not operate in a manner which can be predetermined by program unless thread turns which lie closely against each other are present.

SUMMARY OF THE INVENTION

The object of the present invention is so to develop a thread feed device of this type that its scanning device is optimally developed both with respect to its sensitivity characteristic and with respect to the formation of the signal in proper time, in particular so as to make possible maximum thread passage speeds with the most different threads and different depositing thereof on the storage body.

As a result of this development, there is obtained a thread feed device in which a signal which is analogous to the number of thread turns is reliably supplied even upon longer periods of operation under different conditions Depending on the number of turns of thread deposited on the storage body, the swing arm assumes a given angular position. By the proper arrangement of the swing arm, the result is obtained that the amount of swing per thread turn applied is clearly greater upon the initial application of thread turns onto the swing arm, i.e. in the region of minimum thread supply, than in the case of a larger thread supply, in the case of which the lever ratio between in each case the frontmost deposited thread turn and the arm sensor part increasingly approaches a value of 1 (corresponding to the distance at the time of these components from the point of swing of the arm). The sensitivity in the region of minimal thread supply, i.e. in the critical region, is thus very high. Furthermore, a positive effect is obtained also in the region of maximum thread supply. Upon the progressive winding of thread, there namely results an increasing immersion of the free end of the arm, and thus of the sensor part arranged thereon, into the surface of the storage body. With maximum supply of thread, the sensor part is thus the last to extend completely into the surface of the storage body. In this case, however, it is surrounded by the metallic adjacent surface parts of the storage body. This can lead—in the event of magnetic field detection—to such changes in magnetic flux that the magnetic field intensity at the place of the stationary sensor part clearly decreases, and decreases beyond the amount caused by the pure change in distance. In this way, the reaching of the maximum supply can also be detected with a high degree of sensitivity. This is of importance in particular as a result of the analog evaluation of the thread supply which permits a sensitive adjustment of the thread feed speed as a function of the thread supply at the time or the thread draw-off speed. In this way, namely, the limit regions of minimum and maximum thread supply can also be clearly detected so that the energizing of the motor can be adapted in targeted manner and at the proper time.

The use of a single-arm lever is characterized by structural simplicity together with the advantages mentioned above, the space required being furthermore slight. The arrangement of the swivel axis of the arm below and spaced from the surface of the storage body can, on the one hand, be easily realized structurally and, on the other hand, permits a targeted adjustability of the distance between axis of swing and point of emergence of the arm surface with the swing arm fully swung out, and thus a targeted fixing or changing of the sensitivity curve over the measurable thread supply region. The arm itself is preferably arranged lying within a recess in the surface of the wall of the storage body. A uniform restoring force is preferably produced by gravity. This results in a very simple structure which is stable for a long time. For this purpose, the arm is provided on the bottom of a horizontally arranged feed device. Due to the weight of the swingable end of the arm itself, the arm extends, without action on it, out of the recess and protrudes from the surface of the storage body. However, it is also possible to produce the restoring force by a compression spring. In particular, if the restoring force is also adjustable, for instance via the adjustment of the position of the holding plate, the force of reaction of the swing arm can be adapted to threads of different size so that the possible danger of tearing can be excluded. Furthermore, the position of the maximum thread supply, i.e. the position of the frontmost thread turns on the lever in case of maximum supply can be adjusted via the spring-force adjustment in surprisingly simple manner, so that the entire maximum supply quantity of thread can also be regulated. The arm can also be developed as a leaf spring which is fastened on one end below the surface of the storage body and spaced from it and bears a magnet on the other end. The arm can be straight or curved. The inclined passage of its upper side out of the outer surface of the storage body is important so that individual turns can swing it only by a partial amount into the drum. It may consist of a metal or plastic. Upon the maximum protrusion (minimum number of thread turns deposited), the arm advantageously does not form any undercut with respect to the surface of the storage body, so that the first turns applied all contribute equally to the displacement of the swing arm and the thread which moves around the storage body during the drawing off and is withdrawn above the swing arm cannot catch on the arm. For this purpose, the arm can also be developed as a hollow section, in which case the sensor part, in particular in the form of a magnet, is arranged in the hollow space within a preferably U-shaped arm. The application of the passive sensor part on the swing arm has the advantage that the above-mentioned advantages are obtained in more pronounced manner and, furthermore, no electric connecting lines or the like need be introduced into the storage drum and/or fastened on the swing arm.

If the sensor part arranged on the free end of the arm consists for instance of a magnet which cooperates with a stationary magnetic-field detection element, then a given storage supply corresponds to the electrical output signal of the magnetic-field detection element. Due to the change in the magnetic field upon a swinging of the arm, the position of swing and thus the number of thread turns deposited can be precisely determined. The magnetic-field detection element can, in this connection, be arranged either outside the storage body on an extension or else also within the storage body. If a magnetic-field detection element is arranged outside the storage body, then the thread is pulled between it and the magnet. In one advantageous embodiment the magnetic-field detection element consists of a Hall element. Its electric signal is approximately proportional to the measured magnetic field. The path of displacement of the magnet is approximately inversely proportional to number of turns deposited on the arm. In order to keep the weight of the arm as low as possible, the magnet can also be arranged stationary, the sensor part arranged on the free end of the arm being then formed by a magnetic-field detection element, which preferably is a Hall element. The magnet preferably consists of a nickel-cobalt or samarium-cobalt alloy. The analog electrical signal is used to regulate the feed of the thread. The feed of the thread can be effected, for instance, by a feed arm which rotates around the axis of the storage body, or a feed disk. The level of the electric signal is then used to change the speed of rotation of the feed arm or of the feed disk. For example, the speed of rotation is so controlled that it decreases with an increase in the storage supply. By the signal, which is produced as an analog to the storage supply, even small changes in the number of turns withdrawn can also be compensated for rapidly and in timely fashion by a change in the feed. It is preferred that the distance between magnetic-field detection element and magnet be substantially greater than the maximum displaceability of the magnet. In this way, one can operate in less strongly curved regions of the characteristic curve of the change-in-distance/magnetic-flux-density curve within which the nonlinearity is thus reduced. Furthermore, sufficient room remains for the drawing off of the thread. The invention has been found to have the particular advantage that only a single punctiform sensor which gives off an analog signal may be sufficient. As compared with the large number of light barriers arranged one behind the other as known from the prior art, only a single sensor need be used in this case. This means a considerable simplification in construction. It is furthermore advantageous that an optical illuminating of the supply of thread can be dispensed with. In this way, the result is obtained that even reflective yarns and, in particular, silver or metallic yarns, can be used without any problem. This is true even in the case of optical scanning.

Upon the use of optical scanning, the instantaneous position of the swing arm is detected in particular by reflection of the beam of light on the swing arm and evaluation of the locus of the point of impingement of the light beam so that here also the yarn has no direct influence on the measurement parameters. The providing of an analog signal for the control of the feeding of the thread is also particularly advantageous. The control electronics can be designed considerably simpler than in the case of digital signals.

In a preferred embodiment, the thread turns are deposited, spaced apart from each other, on the storage body and transported forward while retaining this spacing. Surprisingly, it has been found that despite the space between the thread turns, it is possible, in reliable and precise manner, to detect the thread supply over the swingable obliquely extending swing arm without the front thread turns being pressed apart by the force of reaction of the arm or pushed towards the rear. In particular, upon the use of a conveyor arranged within the storage body, as known for instance from EP-A 0 244 511, there is obtained a levering of the front thread supply turns onto the swing arm so that the latter is pressed inwards corresponding to the instantaneous amount of the thread supply without the distance between the thread turns shifting. The interruption in the uniform angular distribution of the feet of the conveyor does not, contrary to all expectations, impair the advance. This is true also in the case of very slight thread winding tension or when no thread withdrawal takes place. In this connection, there is preferably provided a minimal thread supply region which assures that the front thread turns can be applied on the arm in larger number and without loosening. The magnetic field, which is variable by the displacement of the magnet, can be measured, preferably by a Hall element. However, other magnetic-field detection elements are also advantageous, such as, for example, an induction coil which is energized for instance by an energizing voltage and the saturation behavior of which or some other parameter, such as its inductivity, is evaluated. In view of the reciprocal relationship between magnet deflection and number of thread loops deposited and the nonlinear relationship between distance and magnetic field intensity, there is preferably provided an electronic circuit which is so corrected for distortion that an electric voltage which is as proportional as possible to the number of thread turns deposited is produced. In particular, the signals are spread when the storage is practically full. The analog signal of the scanning device is preferably evaluated in such fine steps that each additional turn of thread deposited produces an evaluatable analog-signal level difference and thus an adaptation of the speed of rotation of the rotary drive. In this way, even with spacing between the thread turns, an exact detection of the thread supply can be effected even if only a single additional thread turn is wound on or off. In this way, a very rapid and sensitive change in the speed of the feed of the thread is possible, which feed can then immediately adapt itself to the actual speed with which the thread is drawn off.

In a preferred embodiment, a controller is present in order to regulate the rotary drive so that the supply of thread on the thread storage can be maintained relatively constantly at a sufficiently high value. By the use of a limited proportional part of the controller, the result is obtained that the controller can relatively rapidly level out changes in the thread supply without the danger of control oscillations resulting.

The conversion of the level of the output signal of the scanning device or the controller into a signal of corresponding frequency results in the advantage that the following driver components are insensitive to possible variations in the amplitude of the signal fed to them so that voltage variations based on changes in feed voltage or the like do not have a negative effect. Furthermore, the frequency signal can be converted in simple manner by the logic circuit into a corresponding pulse-duty factor, for which purpose the frequency signal can merely be combined in simple manner with a phase-driver signal produced by the logic circuit. By maintaining the ratio between driver signal voltage and driver signal frequency constant, there is the additional result that the output moment of rotation of the drive device is maintained constant, particularly when using a synchronous motor. In this way, changes in speed of rotation do not have any effect on the moment of rotation and thus on the thread tension which is exerted on the thread fed. In this way, the danger of the breaking of the thread is clearly reduced.

As safety measure to prevent too large or too small a supply of thread, provision can be made to accelerate the motor upon minimal supply of thread or stop it upon maximum supply of thread so that the running empty or overfilling of the thread storage can be avoided.

In order to obtain a sufficient supply of thread on the storage drum as rapidly as possible upon the connecting of the thread feed device, a predetermined speed of rotation is preferably preset upon connection, it winding the thread rapidly on the storage drum. The predetermined speed of rotation is preferably so selected that the probability of an extensive initial full winding of the storage drum with thread turns is relatively high, so that at the time of the drawing off of the thread which is started subsequently a sufficient supply of thread is present. The predetermined speed of rotation is preferably set at about 25% of the maximum speed of rotation.

Furthermore, it has surprisingly been found that the maximum switch point at which the winding motor is turned off can be adjusted in its position both by the thread tension which can be set via a thread brake, and by the thread package spacing between adjacent threads. Higher winding tension and/or smaller distance between threads lead namely to an earlier pushing of the lever into the maximum-supply switch-point position than with a lower tension of the package or greater distance between threads. In this way, the amount of the thread supply upon maximum supply can be adjusted.

BRIEF DESCRIPTION OF THE DRAWINGS

The invention will be explained in further detail below on basis of embodiments with reference to the drawing, in which:

FIG. 2 is a detailed view, shown partially in section and partially in diagrammatic form, of an analog thread-supply detection device which is a part of the feed device shown in FIG. 1;

FIG. 3 is a section along the line III—III of FIG. 2;

DETAILED DESCRIPTION OF THE PREFERRED EMBODIMENTS

Figure 1:
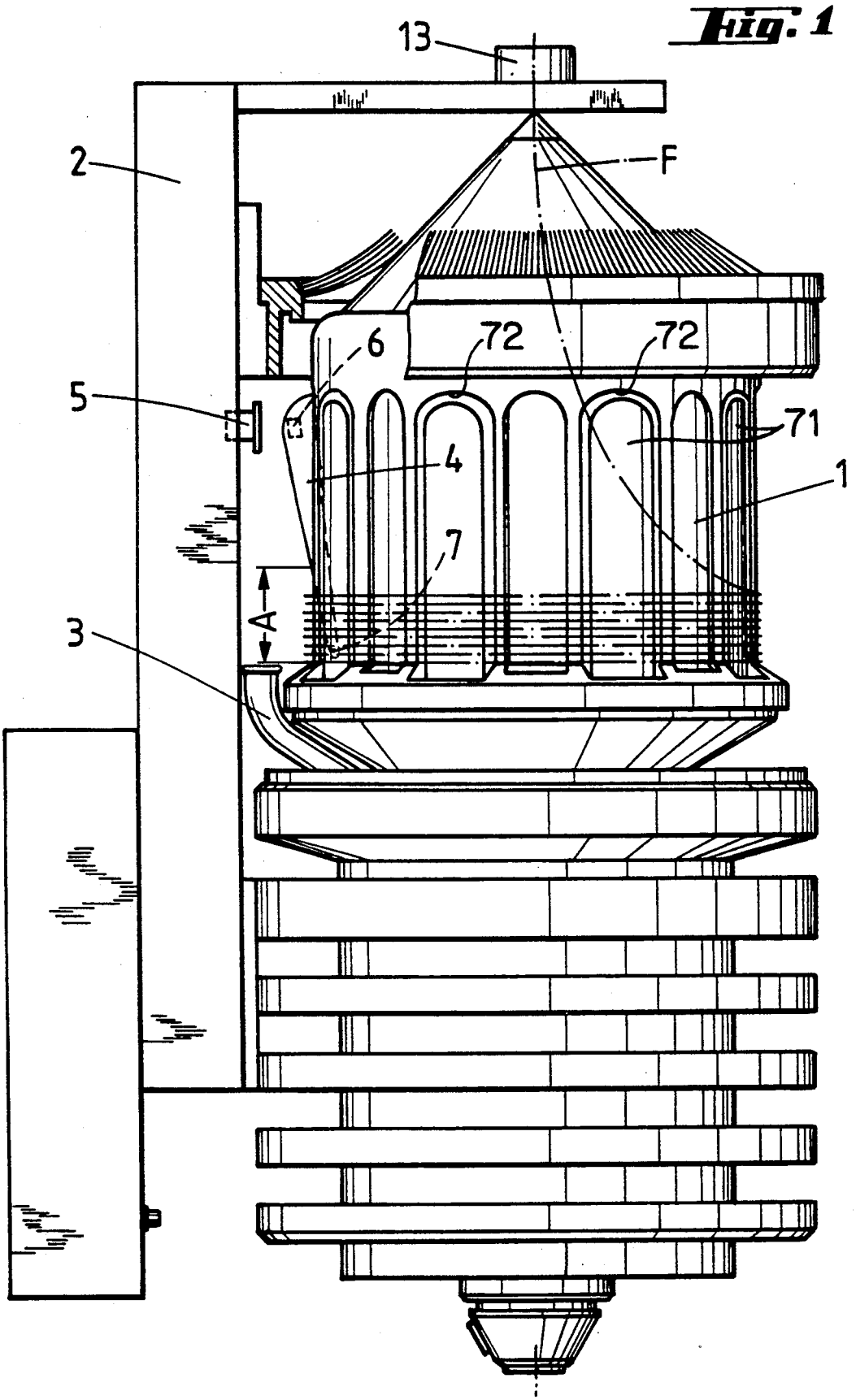
FIG. 1 is an elevational view of a thread feed device in connection with which the invention can be used.

The thread feed device shown in FIG. 1 comprises a drum-shaped storage body I on which a thread F is wound by means of a feed arm 3 rotating around the longitudinal axis of the storage. Instead of the protruding feed arm 3, there can also be provided a feed disk driven in rotation which is provided near its outer circumference with a passage opening through which the thread F is passed. The thread can be wound on the storage body 1 without spacing between the thread turns. However, the thread is preferably so applied to the storage body 1 that the thread turns are spaced from each other and the wound thread turns are then transported forward while retaining their distance apart. The spaced winding and transporting of the thread turns can be effected by means of a construction such as known from EP-A 0 244 511. In the present invention, transport fingers 71 are used which carry out a pendulum and/or eccentric movement by pivoting relative to a central axis of the storage body 1 so as to transport the thread F forward on the storage body 1. An opening 72 in the storage body 1 surrounds each of the fingers 71 to allow for a rocking movement of the fingers 71 as described in the foregoing publication. The spacing between the thread turns is preferably adjustable.

Parallel to the axis of the storage body and spaced from it, there extends a bracket 2. On its side facing the bracket 2 the storage body 1 has a recess 12 (FIGS. 2, 3) which extends axially over practically the entire length of the storage body and into which a swing arm 4, in the following referred to as the arm, places itself. The arm 4 is swingably mounted at one end on a swing shaft 7 which faces the thread feed side, while the free end of the arm 4 is directed to the thread draw-off side so that, when the thread turns are not deposited or only partially deposited on the arm 4, it protrudes outward from the outer surface of the storage body. The top side of the arm 4, which is acted on by a correspondingly weak restoring force, extends in axial direction, preferably linearly inclined at an acute angle (about 15°) out of the outer surface of the storage body so that the thread turn or turns supported on it push the swing arm in further. Of course, the top side can, however, also be curved so as to establish the arm-swing/magnetic-field-intensity curve on the magnet detection element in desired manner, as long as such curvatures do not prevent the analogy evaluation over the entire length of the arm. The swinging of the swing arm 4 takes place radially to the storage body 1, preferably in a plane containing the center axis of the storage body.

The swing shaft 7 lies below the outer surface of the storage body within the storage body 1 close to the thread feed section—but spaced from the thread feed plane—and preferably extends transverse to the longitudinal axis of the storage body. Between the thread feed section and the point of emergence of the fully outwardly swung arm 4, i.e. not yet provided with thread turns, the storage body 1 has a region A which serves to receive a minimum thread supply. The arm 4 is thus increasingly swung inward only when the region A of the storage body is full, i.e. a minimum thread supply of turns of fixed circumferential length is assured, and the feeding of the thread is continued further. The preparing of a minimal thread supply before the start of the pushing in of the arm 4 has the advantage that the thread turns deposited on the arm cannot have their thread tension weakened by the outwardly directed force of the action of the arm 4, since the thread turns in front thereof on the feed side would block a pulling of the thread out of this region. Furthermore, the ring of bristles on the draw-off side effects a braking of the thread with respect to reverse movement of the thread so that the bristle ring to this extent has a two-fold function. In this connection, even possible slight yielding of the frontmost thread turn deposited on the arm 4 surprisingly does not cause any problem since, on the one hand, due to the outwardly pressing arm 4, a thread tension which is nevertheless sufficiently good and homogeneous is assured while, on the other hand, the turns following the frontmost thread turn and which are deposited upon the transport with mutual spacing, so to say package-wise, on the arm 4, cannot pull back from the previous or following thread turns as a result of the enormously high friction established by the wrapping and, accordingly, cannot loosen. Even when the arm 4 is completely covered with thread turns, its top side never comes into a position parallel to the outer surface of the storage body.

The thread F is pulled off overhead on the draw-off side, on the side of the storage body lying opposite the feed side, through a central draw-off eye 13, a balloon which forms thereby being tied off by a bristle ring which annularly surrounds the storage body on the thread draw-off side. The thread turns lying on the arm 4 effect a displacement of the arm 4 in the direction towards the axis of the storage body 1, the extent to which the arm 4 is pressed inward being in direct relationship to the number of thread turns deposited on the storage body. The arm 4 is urged in outward direction by a compression spring 10 (FIG. 2) and bears a magnet 6 on its free end. The arm 4 is preferably of U-shaped cross section with arms directed towards the longitudinal axis of the storage, the magnet 6 being on the bottom of the middle web of the arm 4; see FIG. 3. Accordingly, the lever is rounded and without projections in the region of the thread winding, so that the thread which is withdrawn over the arm 4 cannot catch on the arm 4. A magnetic field sensor (magnetic field detection element) 5, preferably in the form of a Hall element, is arranged opposite the magnet 6 on the bracket 2. The magnet 6 may consist of a cobalt-nickel alloy or a samarium-cobalt alloy. If the arm is deflected to a greater or lesser extent upon the feeding or removal of the thread supply, in which connection the distance x between the top side of the arm 4 and the top side of the storage body 4 changes accordingly, the magnetic field produced by the magnet 6 which acts on the Hall element 5 also changes, so that the voltage of the Hall element is varied accordingly. The output signal of the magnetic field sensor (Hall element 5) is applied via a signal line 11 to an analog signal transmitter 8 which will be described in further detail with reference to FIG. 4. The output signal of the analog signal transmitter 8 is fed to a control device, generally designated 9, which is also shown in further detail in FIG. 4.

The analog signal transmitter 8 can contain an electronic distortion-removal circuit which, in particular, spreads the signal which extends approximately reciprocally to the deflection x and exhibits smaller changes in the region of a large number of deposited turns so that the signal is approximately proportional to the number of thread turns deposited. Depending on the output signal of the analog signal transmitter 8, the control device 9 controls the speed of rotation of the drive motor for the feed arm 3. Alternatively, the control device 9 can also control an infinitely variable gearing for the drive of the feed arm, which gearing is connected with the drive motor, or some other component which affects the drive power.

With minimum thread supply, the arm 4 has its maximum outward protruding deflection, while with maximum thread supply, the arm 4 is pressed completely into the storage body 1 by the thread turns which lie on it. Between these two limit positions, the magnetic field intensity acting in the Hall element 5 changes, and thus the output amplitude of the analog signal transmitter 8 corresponding to the supply of thread present at the time.

The storage body 1 also has a region B on the draw-off side in front of the free end of the arm. In said region, the thread turns are possibly transported without spacing if they lie on the other side of the end of the fingers 71. This can be done by longer continued running of the drive after the stop signal. With high speed devices (about 3000 rpm), fractions of a second are frequently sufficient for such a continued-travel overfilling of the storage body.

Figure 2A:
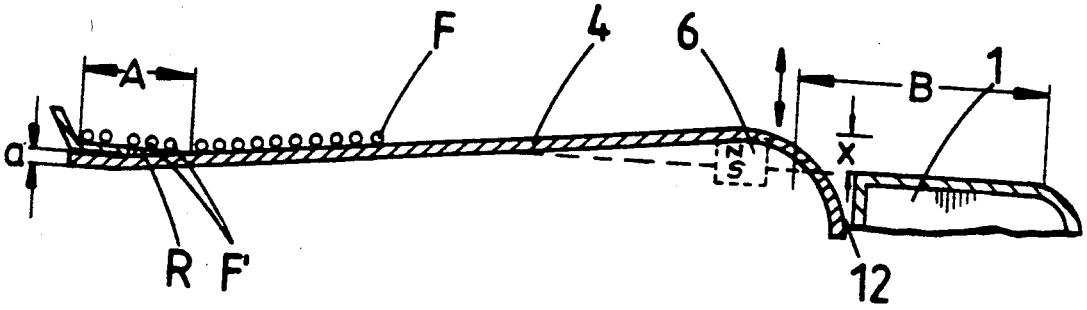
FIG. 2A shows an alternative embodiment of the structure of FIG. 2 wherein an arm is formed as a leaf spring.

The magnetic field sensor 5 can also be arranged within the storage body 1. Furthermore, the magnet 6 can be arranged fastened on the bracket 2 or in the drum 1, while the Hall element 5 is arranged on the free end of the arm 4. In this case, the mass of the arm is particularly slight, so that the compression spring 10 can be made very small. This permits very uniform drawing off of the thread. As an alternative, the arm 4 can also be developed as spring leaf so that a compression spring is not necessary as shown in FIG. 2A.

Figure 4:
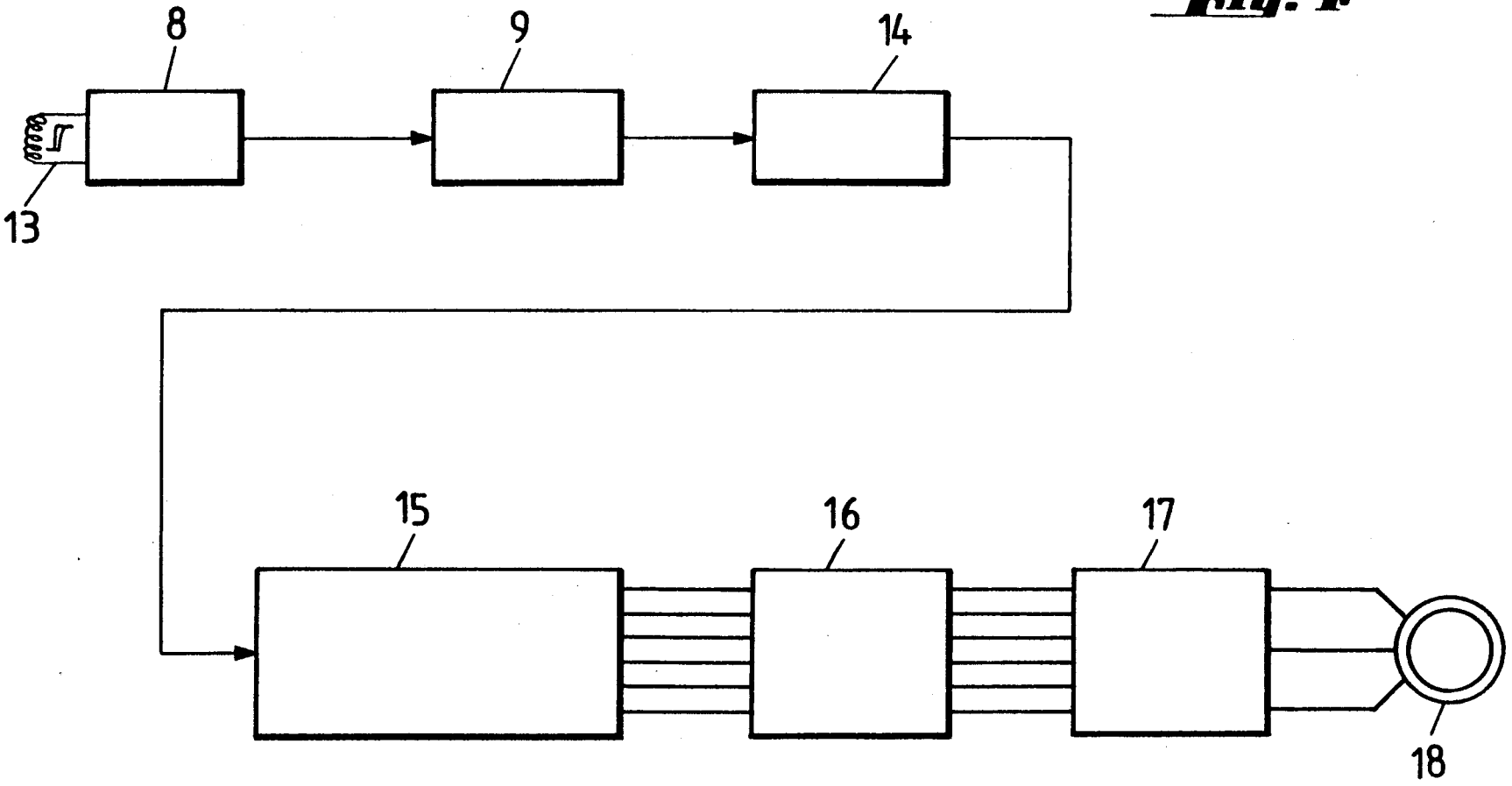
FIG. 4 is a block diagram of an embodiment of the drive control circuit used in the invention.

FIG. 4 shows an embodiment of the drive control circuit used in the invention. In this embodiment, the analog signal transmitter 8 is connected to a magnetic field sensor in the form of a coil 13 which is provided with a core of material of high permeability (Mumetal). The coil 13 is preferably fixed on the bracket 2 and is traversed by the magnetic field produced by the magnet 6, the magnetic field intensity acting in each case at the place of the coil 13 being a function of the distance between coil 13 and magnet 6.

The analog signal transmitter 8 in this case causes a corresponding excitation of the coil 13 and measures the signal parameters which vary as a function of the corresponding intensity of the magnetic field, such as the inductivity and/or the magnetic saturation, as a measure of the instantaneous size of the supply of thread on the storage body 1. For example, the coil can be fed pulse-wise with direct current or direct current voltage and the time of the delay, which is a function of the magnetic flux actually acting on the coil 13, until the occurrence of the voltage pulse on the output side of the coil, i.e. until the saturation of the coil has been reached, is measured and evaluated. The analog signal transmitter 8 produces a corresponding analog output signal which is applied via a signal line to the control device 9. The processing of the analog output signal preferably is effected in such fine steps that each additional turn of thread deposited on the arm 4 or withdrawn from it—even in the case of the smallest or largest thread-turn spacing adjustable—leads to a corresponding adaptation of the rotary-drive driver signals. As a function of the level of the analog output signal of the analog signal transmitter 8, the control device 9 produces a corresponding output signal (setting variable) of variable level which is fed to a subsequent voltage/frequency converter 14. The control device 9 can be designed as proportional-integral controller (PI controller), the integral components of which are developed, for instance, by digital technique. This permits simple production in integrated circuit technique. The proportional part of the PI controller is preferably between 10% and 20% of the maximum controller output signal for maximum controlled speed of rotation. Instead of a PI controller, however, any other suitable controller can also be used.

The voltage/frequency converter 14 converts the variable-level output signal of the control device 9 into a frequency signal the frequency of which is in direct, preferably linear, dependence on the voltage amplitude on the input side.

The output-side frequency signal of the voltage/frequency converter 14 is fed to a logic circuit 15 which carries out a pulse-width modulation as a function of the frequency of the frequency signal fed. In detail, the logic circuit 15 controls the pulse-duty factor or chopping frequency of the driver signals (phase voltages) given off by it via six output lines corresponding to the frequency signal present on the input side. The six output lines of the logic circuit 15 are connected to a driver device 16 which at the same time serves for displacing and adjusting the level. The driver circuit 16 is connected via six output lines to a power transformer 17 which is connected via three phase lines with a motor 18 designed as asynchronous motor. The motor 18 serves as drive device for the feeding of the thread, i.e. the feed arm 3.

The logic circuit 15 effects such a control that the ratio between driver signal voltage and driver signal frequency of the driver signals fed to the motor 18 is maintained constant. This has the advantage that the output moment of rotation of the motor 18 remains constant. In order to avoid too rough a non-uniform operation of the motor with very low speeds of removal of the thread, the minimum controlled motor speed of rotation is clearly above 0, and preferably at 5% of the maximum speed of rotation of, for instance, 4000 rpm. The dynamic speed of rotation control region thus has a factor of 20.

It is furthermore monitored whether the output signal of the analog signal transmitter 8 approaches or has, for at least a predetermined time interval of for instance 100 ms, a level which represents approximately minimum or maximum thread supply. When this condition is noted, the motor 18 in the event of minimum thread supply is accelerated to maximum speed of rotation, while in case of maximum thread supply it is stopped. In this way, a rapid refilling of the thread supply is obtained and an overfilling of the thread storage, for instance in the event of the breaking of a thread, is avoided. This monitoring function can be exercised in the control device 9 or in the logic circuit 15.

It is furthermore provided that, upon the connecting of the thread feed device of the invention, a predetermined value of speed of rotation is set which corresponds to 1/10 to preferably ¼ of the maximum speed of rotation of the motor. In this way, a relatively rapid winding up to a sufficiently high supply of thread, i.e. a relatively strongly depressed arm 4 is obtained, the thread feed tension exerted on the threads fed not being excessively high, so that the danger of the breakage of the thread upon the start of winding is reduced. The predetermined speed of rotation can be obtained by suitable presetting of the controller components, for instance, of the digital integration components or be effected in the logic circuit 15. The predetermined value of the speed of rotation can be installed permanently or be preselected via a manually actuatable switch and in the latter case is, accordingly, variable.

Figure 5:
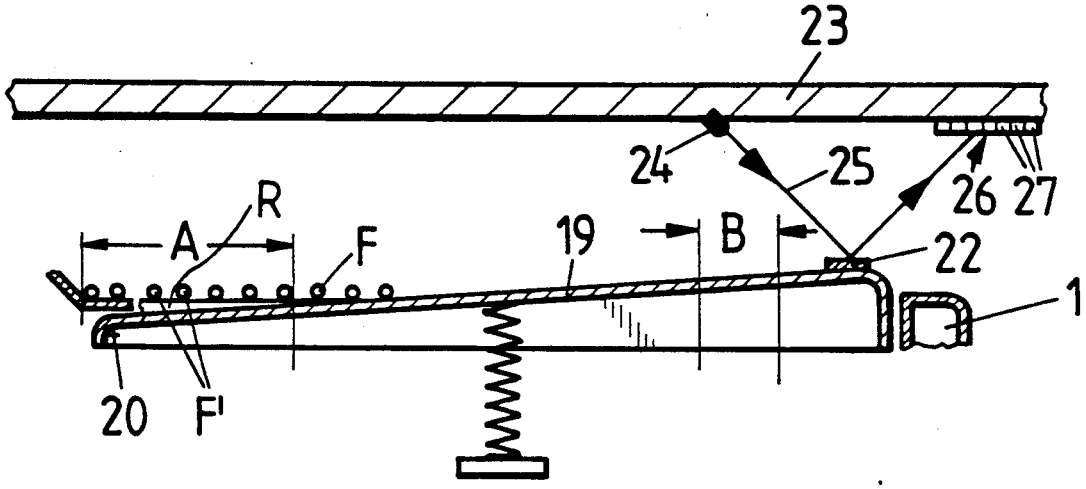
FIGS. 5 and 6 are views, partially in section of further embodiments of the thread-supply scanning device.

FIG. 5 shows another embodiment of the scanning means of the thread feed device of the invention. In this embodiment, an elongated swing arm 19 is used which is longer than the swing arm 4 of the preceding embodiment. With respect to the arrangement and support of the swing arm 19 and its introduction in the storage body, there are otherwise however no differences from the embodiment in accordance with FIGS. 1 to 3, so that to this extent reference is had to what has been stated above with regard to them.

In the same way as in the preceding embodiment, a minimum thread supply region A as well as a maximum thread supply region B are present also in the embodiment of FIG. 5. As long as the thread supply remains in the region A, the swing arm 19 is in the maximum outwardly swung position, while in the case of a thread supply extending up to the region B, it is swung maximally inward. In the region between the regions A and B, the instantaneous position of swing of the swing arm 19 corresponds analogously to the actual thread supply, since the swing arm 19 is pressed inward so far by, in each case, the front thread turns that the surface of the swing arm lies along the frontmost thread turn directly at the height of the outer surface parts of the storage body 1 which laterally adjoin the swing arm 19.

The swing arm 19 is mounted on a swing shaft 20 which extends at right angle—spaced therefrom—to the longitudinal axis of the storage body and bears a mirror 22 on its free end which, in the event of the unwound or only partially wound swing arm, protrudes out of the outer surface of the storage body. This mirror can be developed also as recessed partial surface of the arm 4. As shown, the mirror 22 is arranged on the other side of the maximum thread supply region B, i.e. in a region which is never covered by thread turns. Thus, the surface of the mirror 22 is always free and is thus not covered by the turns of thread so that the nature of the thread used in each case and the distance between the thread turns does not exert any influence on the quality of reflection of the mirror 22. A transmitter 24 which sends out electromagnetic waves is arranged outside the storage body 1 on an extension 23 which lies opposite the swing arm 19 and is preferably fixed in space. The transmitter 24 is preferably developed as a phototransmitter which produces a beam of light 25. The phototransmitter 24 can be developed as laser diode or as light-emitting diode. As an alternative, it is also possible to use, for instance, an infrared light-emitting diode as transmitter 24. The focused electromagnetic waves produced by the transmitter 24 strike, preferably in the form of the light beam 25, against the mirror 22 and are directed by the latter onto a detector 26 which is sensitive to the electromagnetic radiation used in each case. The mirror 22 is so long and the electromagnetic radiation produced by the transmitter 24 which is arranged obliquely to the mirror 22 is so focused that the electromagnetic radiation, preferably the light beam 25, strikes in every position of swing of the swing arm 19 against the mirror 22 and is reflected by the latter at an angle which corresponds to the angle of impingement. Since the angular position of the mirror 22 shifts swinging with the displacement of the swing arm 19, the angle of impingement and thus the angle of reflection accordingly also vary, so that the place of impingement of the reflected electromagnetic radiation on the detector 26 varies in accordance with the instantaneous position of swing of the swing arm 19. In order to be able selectively to detect in simple manner the position of impingement of the electromagnetic radiation on the detector 26, the detector 26 is divided preferably into individual detector fields 27 which succeed each other in longitudinal direction, corresponding to the longitudinal direction of the swing arm. This arrangement also permits a very simple development, since in each case it need merely be checked which detector field is at the time producing the maximum or minimum photoelectric output signal, which corresponds to the point of impingement at the time of the electromagnetic radiation. Thus, in each case only the output signals of the individual detector fields 27 need be compared with each other, the position of the maximum or minimum being representative for the instantaneous position of the swing arm. This development is particularly advantageous, since environmental light, as a rule, acts uniformly on all detector fields 27 so that merely the output signal levels of the detector fields shift in the same way without this having an effect on the position of the maximum or minimum of the excitation caused by the light beam 25. The reason for this is that it is not the absolute value of the instantaneous detector fields 27 which is evaluated, but merely the relationship of the output signals of the detector fields.

By a sufficiently fine subdivision of the detector 26 into detector fields 27, a very precise determination of the place of impingement and thus a substantially analog detection of the actual position of the swing arm and thus of the actual thread supply are assured.

If the swing arm 19 consists of radiation-reflecting material, the mirror 21 can also be dispensed with, the beam reflection of the electromagnetic radiation of the transmitter 24, preferably the light beam, then being effected by the surface of the swing arm. Instead of a mirror 22, the swing arm 19 can furthermore also be polished or be coated with a reflective coating. Furthermore, it is possible to develop the mirror or reflection region also in the region B or in the region between the regions A and B on the swing arm 19 when the thread F is wound with spacing. Due to the free spaces remaining between the turns of thread, the beam 25 can nevertheless strike the mirror surface or the reflection region and be reflected by the latter to the detector 26. The arrangement shown in FIG. 5 is, however preferred.

As an alternative, it is also possible to dispense with the mirror 22 and, instead of this, to arrange the detector 26 on the swing arm 19. This is simpler from a structural standpoint. However, the development shown in FIG. 5 has the advantage of a higher power of resolution, since the displacement of the position of the point of impingement of the light beam on the detector 26 upon a swinging of the swing arm is clearly greater.

Furthermore, it is possible to locate the transmitter 24 directly on the swing arm 19 in place of the mirror 22 to direct the electromagnetic radiation directly to the detector 26. Upon a swinging of the swing arm, the point of impingement on the detector 26 is then also shifted.

Figure 6:
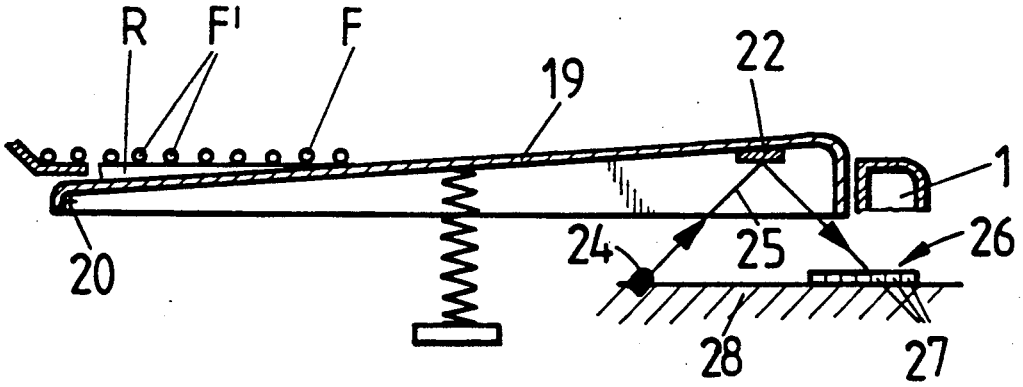

FIG. 6 shows an alternative development which differs from that of FIG. 5 only by the fact that the optical components are arranged in the storage body. Thus, no external extension is necessary. The mirror 22 is arranged on the bottom of the swing arm 19, i.e. faces into the inside of the storage body. The transmitter 24 and the detector 26 with detector fields 27 are arranged on a support 28 which is held, fixed in position, within the storage body. In this embodiment, disturbances by the entry of outside light are even further reduced, since the detector 26 is arranged within the storage body and is thus protected from the action of surrounding light. Furthermore, in the embodiment in accordance with FIG. 6 it is possible to use a shorter swing arm 19 which, for instance, merely has the length of the swing arm 4 (FIGS. 1 to 3). As a result of the arrangement of the mirror 22 on the bottom side of the swing arm, the mirror can namely also be arranged in the region of the maximum supply B or in the region lying between the regions A and B without the reflection, and thus the measurement, being disturbed in any way by turns of threads which are wound on.

It is also possible in the embodiment in accordance with FIG. 6 for the electromagnetic radiation 25 to act directly on the bottom of the swing arm rather than on the mirror and be reflected from there or to arrange the detector 26 or the transmitter 24 at the place of the mirror 22, as already explained in connection with FIG. 5.

Figure 7:
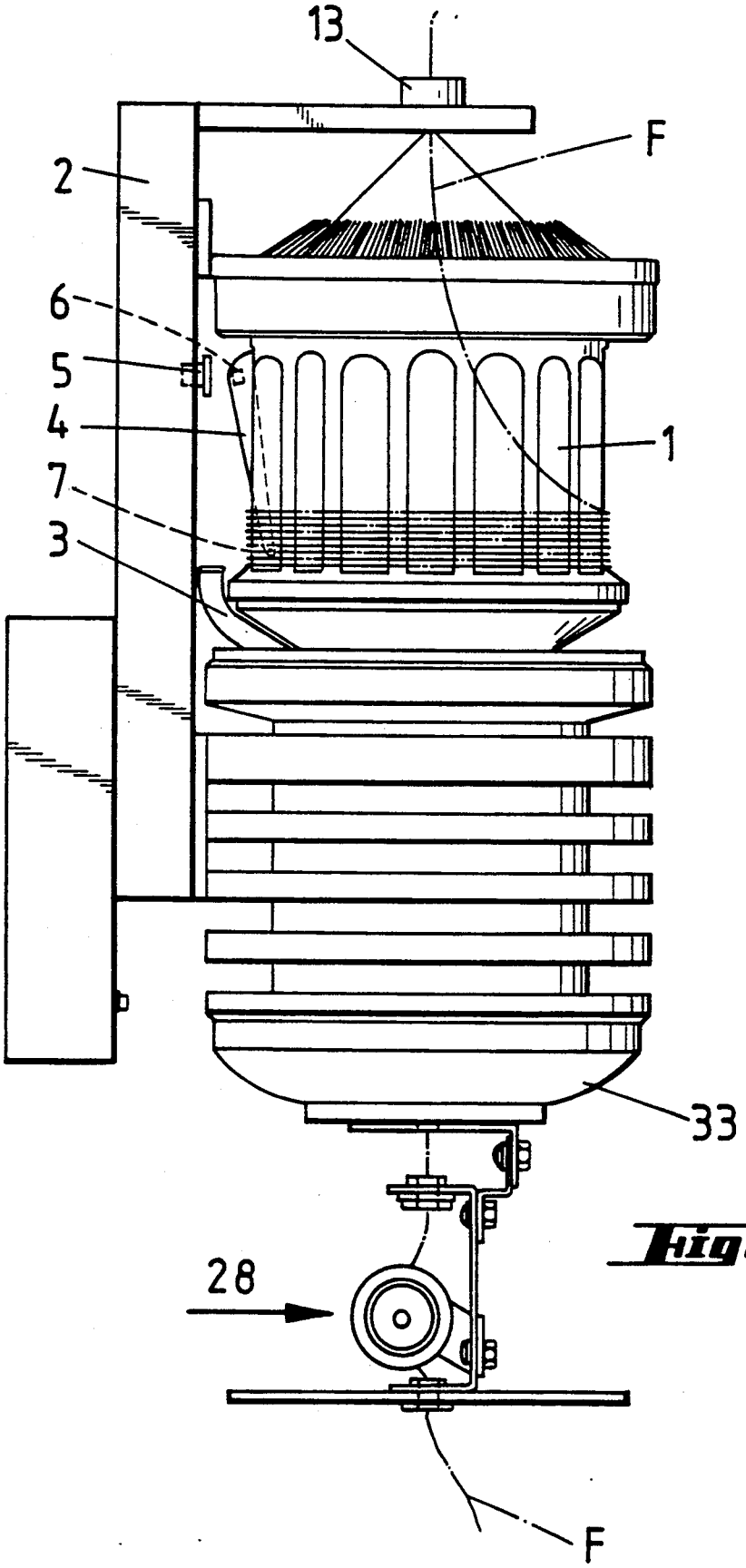
FIG. 7 is is an elevational view of a further embodiment of the thread feed device with additional thread brake.

FIG. 7 shows another embodiment of the thread feed device which is equipped with a thread brake 28 on the thread feed side. The other details of the embodiment agree with the features already described of the thread feed device in accordance with FIGS. 1 to 6 and will accordingly not be described again. The thread brake 28 serves to adjust the thread tension with which the thread F is wound on the winding drum 1. By control of the thread tension, the amount of the maximum thread supply on the winding drum 1 can be determined. With increased thread tension, the swing arm 9 is pressed earlier, i.e. with a smaller thread supply, into the maximum switch point position at which the winding motor is stopped. By the thread brake 28, the result is furthermore obtained that the thread F is always under sufficient thread tension, so that both the thread draw-off process from the storage bobbin and the thread winding take place in a defined manner which is well adapted to the specific type of thread.

Figure 8:
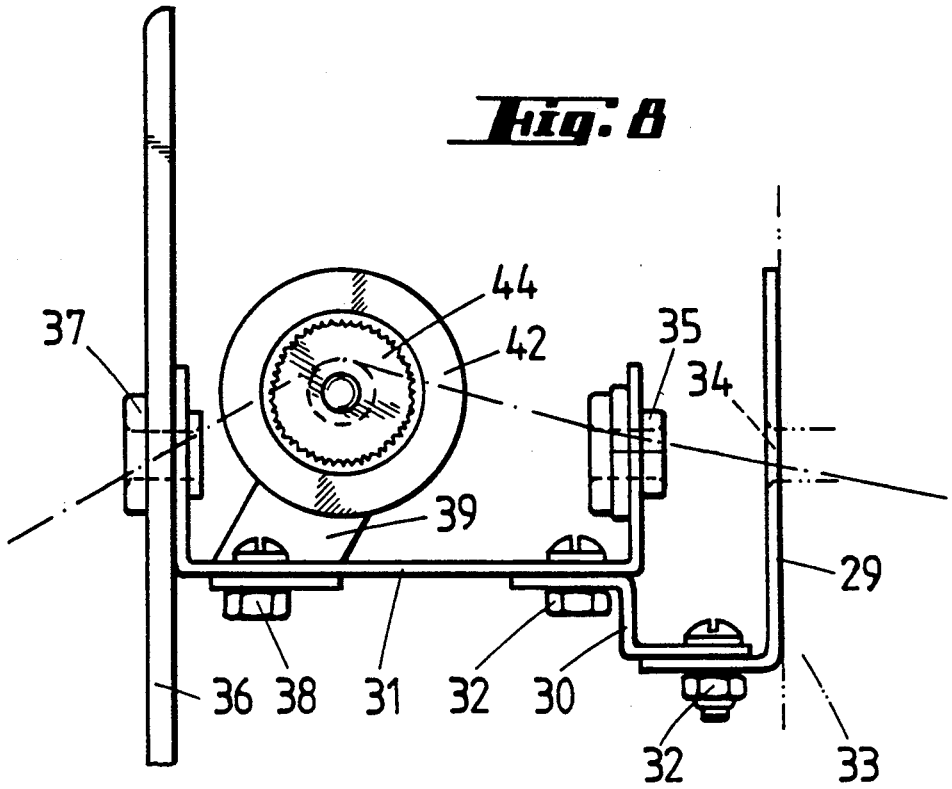
FIG. 8 is an enlarged side view of the thread brake of FIG. 7.
Figure 9:
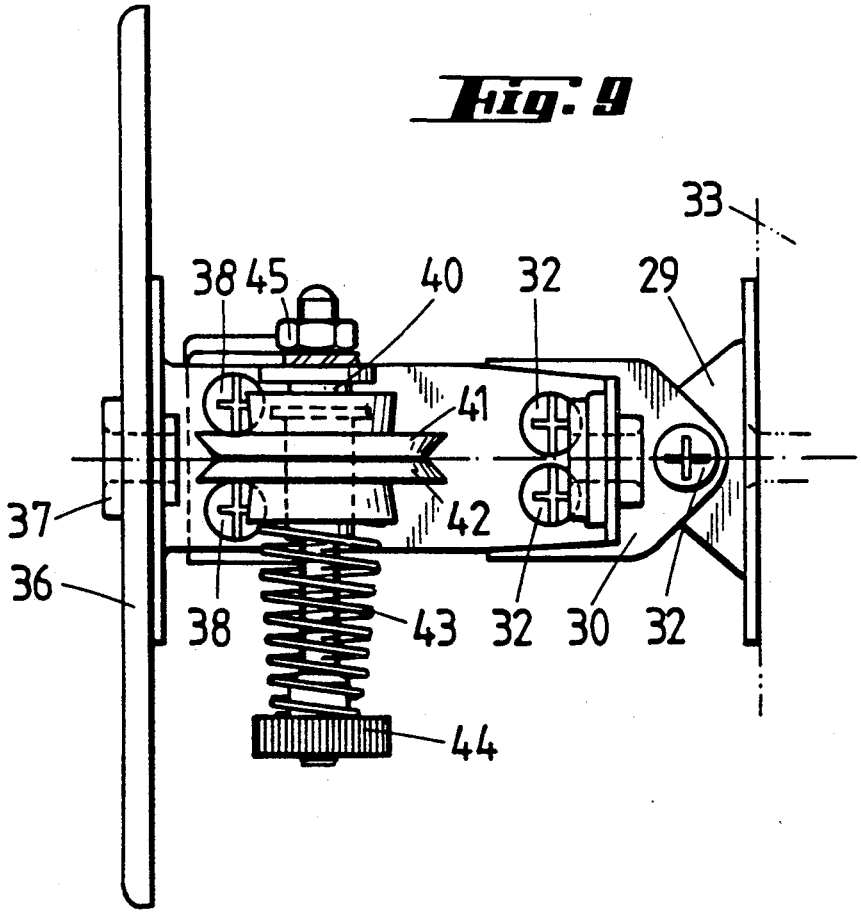
FIG. 9 is a top view of the thread brake of FIG. 7.

As shown in detail in FIGS. 8 and 9, the thread brake 28 has a multipartite support frame of bent plates 29, 30 and 31 which are connected to one another in fixed but disassemblable manner via bolt-nut attachments 32. The L-shaped plate 29 is arranged on the rear of a housing 33 of the thread feed device and is provided with a central passage opening 34 through which the thread F can enter axially into the inside of the housing 33 and via the latter furthermore pass through the feed arm 3.

Between the L-shaped plate 29 and the U-shaped plate 31, there is the plate 30, which is bent in the shape of a Z with right angles and produces an axial spacing as well as a vertical offset between the lower leg of the L-shaped plate 29 connected to it and the bottom, connected to it, of the U-shaped plate 31. The U-shaped plate 31 bears on the vertically upward extending leg to the right in FIG. 8 an opening 35 through which the thread F passes. The opening 35 is aligned with the opening 34. The plate 31 is rigidly connected via its other vertically extending leg to a support 36 which in its turn is arranged firmly on the thread feed device. The support 36 has a thread passage 37 passed through by the thread F which passage also passes through the leg of the plate 31 fastened to the support 36 and is aligned both with the passage 35 and with the opening 34.

A holder 39 which bears the shaft 40 is screwed onto the plate 31 via a bolt-nut attachment 38. On the shaft 40 there are movably arranged two dish-shaped disks 41, 42 with central openings passed through by the shaft 40, said disks consisting of metal of smooth surface and being pressed against each other by a spring 43. In order to be able to adjust the force with which the disks 41, 42 are pressed against each other, a knurled disk 44 is provided which serves as abutment for the spring 43, the other end of which presses against the disk 42 or a component connected to it and which, upon its manual rotation, moves either towards the disk 42 or away from it, depending on the direction of rotation. In this way, the spring 43 is compressed to a greater or lesser extent so that a corresponding variable force of application between the disks 41, 42 is obtained. In this way, the braking force of the thread brake is adjustable.

The thread F is passed between the disks 41, 42, the plane of application of which agrees with the plane of travel of the thread F. The thread F is, to be sure, guided above the shaft 40 over same, which is shifted upward in height with respect to the passage openings 34, 35, 37 for the thread. The thread F is thus guided at an angle, as can best be noted from FIG. 8. In this way, assurance can be had that the thread passes in defined manner between the disks 41, 42 and thus the braking force of the thread brake 28—with unchanged position of the knurled disk 44—remains constant. The holding of the shaft 40 is supported by a lock nut 45.

Figure 10:
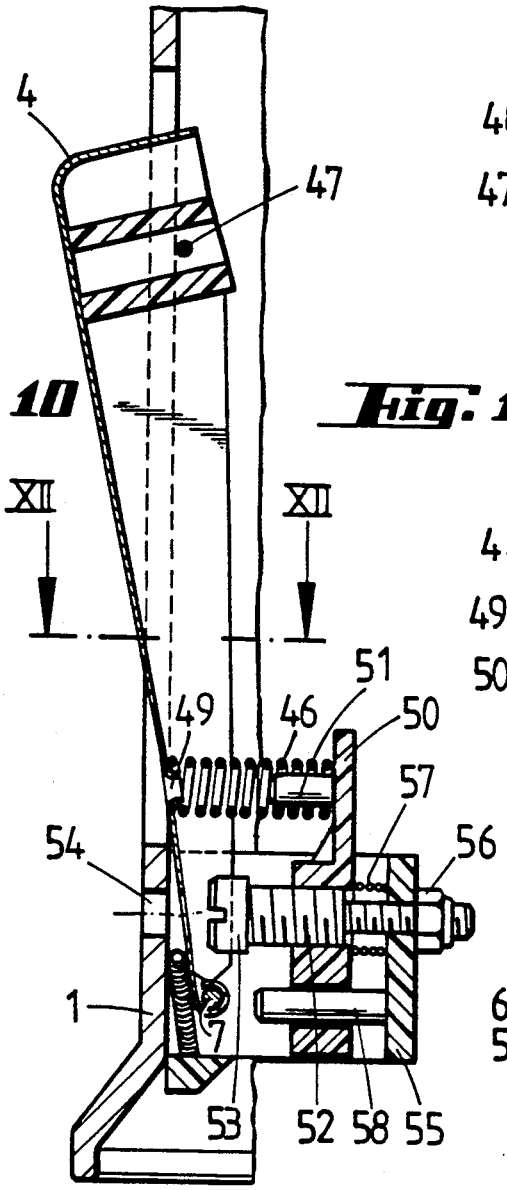
FIG. 10 is a sectional view of the swing arm together with its lever support.
Figure 11:
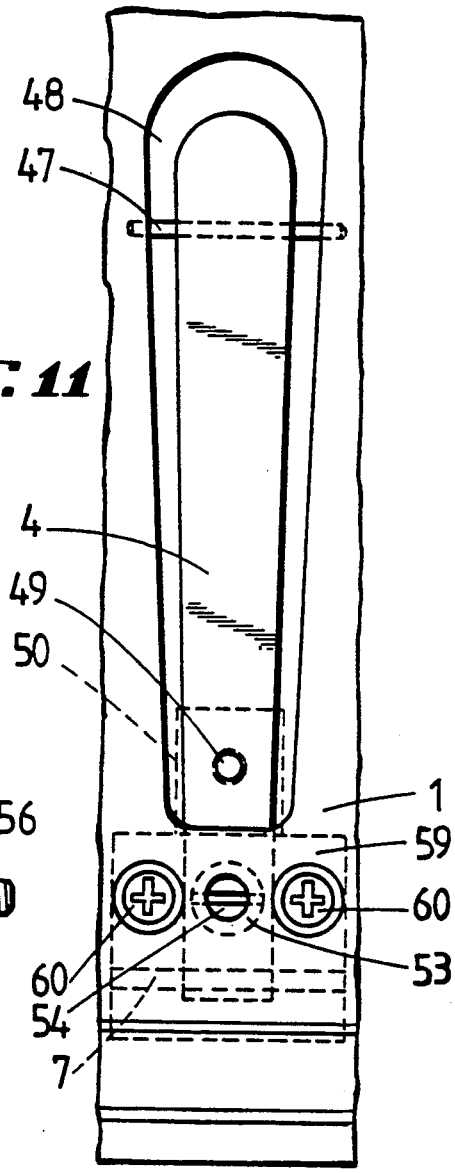
FIG. 11 is an enlarged top view of the swing arm.
Figure 12:
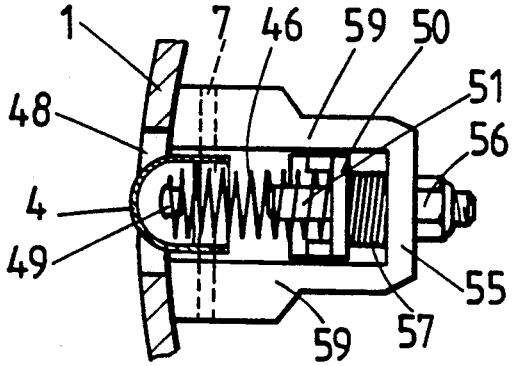
FIG. 12 is a sectional view along the line XII—XII of FIG. 10.

In FIGS. 10 to 12, the mounting of the lever or swing arm 4 is further described. The swing arm 4, which is swingable around a swing shaft 7, is urged in outward direction by a spring 46. The outward movement of the swing arm 4 is limited by a pin 47 which passes through the swing arm 4 and extends transverse to it. The length of the pin 47 is greater than the width of a recess 48 provided in the storage body 1 and receiving the swing arm 4 so that the pin 47 comes against the bottom of the walls defining the recess 48 when the swing arm 4 is moved to the maximum outward.

The spring 46 lies against the bottom of the swing arm 4 in the region of a projection 49 on the swing arm 4. The projection 49 can be formed by pressing material of the swing arm 4 inward or by a pin. On the other side, the spring 46 rests against an abutment plate 50 which is adjustable in height and which is provided, for the positioning of the spring, with a pin 51 which extends into the inside of the spring. By adjusting the vertical position of the abutment plate 50, the spring tension of the swing arm 4 can be adjusted and thus its reaction upon the winding-on of thread turns adapted.

The vertical adjustment of the abutment plate 50 is effected by an adjustment screw 52 which is arranged within the storage body 1 and acts on the abutment plate 50. The screw head 53 of the adjustment screw 52 is accessible from the outside through an opening 54 in the storage-body housing 1 so that manual adjustment of the tension of the spring arm is possible by introduction of a screwdriver.

The adjustment screw 52 passes through the abutment plate 50 and a bottom plate 55 which extends parallel thereto and is arranged firmly on the storage body 1. A nut 56, which is preferably arranged firmly on the bottom plate 55 and is passed through by the adjustment screw 52, acts on the bottom of the bottom plate 55.

Between the abutment plate 50 and the bottom plate 55, there is a compression spring 57 which presses these said two parts apart.

The adjustment screw 52 has a stepped cross section, the thicker part which is close to the screw head at least partially passing through the abutment plate 50 which is also thickened in the region of passage of the adjustment screw 52 and the adjacent section of the screw of thinner cross section passing through the compression spring 57 and the nut 56. The transition shoulder between the thinner and thicker sections of the adjustment screw 52 can rest against an annular projection of the abutment plate 50 in the region of passage of the adjustment screw 52, so that it participates in axial displacements of the screw shoulder upon the turning of the adjustment screw 52. As an alternative, the adjustment screw 52 can be in threaded engagement with the abutment plate 50 so that the latter is screwed upward or downward along the thread of the adjustment screw 52 upon the turning of the latter.

In order to assure a parallel displacement of the abutment plate 50 upon the adjustment processes, a guide pin 58 is present which extends from the bottom plate 55 parallel to the axis of the adjustment screw 52. The guide pin 58 passes through a corresponding passage opening in the abutment plate 50, so that the latter can neither tilt nor turn upon adjustment movements.

As can be noted from FIGS. 11 and 12, the bottom plate 55 is connected to sidewalls 59 of the adjustment housing, which in their turn are screwed by screws 60 to the storage body 1.

The features of the invention disclosed in the specification, the drawings and the claims of the present application as well as of the priority applications indicated can be of importance both individually and in any desired combination for the reduction to practice of the invention and are thus essential to the invention, either by themselves and/or in combination with each other.

I claim:

1. A thread-delivery device having a storage body on which thread turns of a thread fed at one end in circumferential direction are deposited and from which the thread is withdrawn in axial direction (overhead), the storage body having on outer surface in the shape of a drum upon which turns of the thread are displaced during a feeding of the thread, the device comprising a scanning device adjacent the storage body for scanning the thread turns as the thread turns are displaced from one end of the drum to the other;

wherein said scanning device comprises a swing arm which extends over a thread storage region of the storage body, a stationary sensor part positioned in fixed relation to the storage body, and a movable sensor part carried by the swing arm, the swing arm being swingable towards and away from the storage body;

the storage body has a feed-side end region, the swing arm is mounted in the thread feed-side end region of the storage body, the swing arm has a free end extending in a direction of displacement of the thread turns, there being in all positions of swing of the swing arm an inclined attitude with respect to the outer surface of the storage body, the swing arm being covered with wound turns of the thread;

the thread delivery device further comprises force means for exerting a restoring force against the swing arm, the position of swing being determined against the restoring force by a deposit of a first of the wound thread turns to control the position of the movable sensor part;

means for winding thread on said storage body, and means coupled to said winding means for varying a winding speed;

said moveable sensor part cooperates with the stationary sensor part to provide at the stationary sensor part a sensor signal indicative of the position of the moveable sensor part, with speed varying means being responsive to said sensor signal to attain a reduction in a thread winding speed corresponding to an increasing covering of the length of the swing arm with thread turns;

the moveable sensor part comprises a magnet disposed on the free end of the wing arm, and the stationary sensor part comprises a magnetic field detection element disposed outside the storage body; and the thread winding speed is varied by said varying means corresponding to a change in a field strength at the magnetic field detection element which is caused by a distancing of the magnet from the magnetic field detection element.

2. A thread delivery device according to claim 1, wherein the free end of the swing arm protrudes outward from the outer surface of the storage body in the absence of thread turns or in the event of only partially deposited thread turns upon the swing arm.

3. A thread feed device according to claim 1, wherein the swing arm is rigid, and includes a single-arm lever supported at one end.

4. A thread feed device according to claim 1, further comprising a swing shaft to serve as pivot for the swing arm wherein the swing shaft of the swing arm is arranged below and spaced from the outer surface of the storage body and an upper side of the swing arm extends linearly at an acute angle from said surface.

5. A thread feed device according to claim 1, wherein there is a recess in the outer surface of the storage body, and sections of wound thread bridge over the recess; and the swing arm lies in the recess in the outer surface of the storage body, and an upper side of the swing arm located in a region above its swing shaft is spaced from sections of the thread which bridge over edges of the recess.

6. A thread feed device according to claim 1, wherein said force means for displacing the swing arm in opposition to the force of gravity.

7. A thread feed device according to claim 1, wherein said force means comprises a compression spring; and the swing arm can be displaced against the restoring force of the compression spring.

8. A thread feed device according to claim 7, further comprising an abutment plate, wherein the compression spring rests against the abutment plate, a distance from the plate to the swing arm being adjustable.

9. A thread feed device according to claim 1, wherein the spring arm is developed as a leaf spring.

10. A thread feed device according to claim 1, wherein the swing arm has a curavature which is directed outward from the storage body.

11. A thread feed device according to claim 1, wherein the swing arm has a U-shaped cross section.

12. A thread feed device according to claim 1, wherein the magnet consists of a cobalt-nickel or samarium-cobalt alloy.

13. A thread feed device according to claim 1, wherein a distance between the magnetic-field detection element and the magnet is substantially greater than a maximum displacement of the magnet.

14. A thread feed device according to claim 1, wherein the magnetic-field detection element comprises a Hall element.

15. A thread feed device according to claim 1, wherein the magnetic-field detection element comprises a coil.

16. A thread feed device according to claim 15, further comprising measuring means, wherein the coil is energized with electric voltage, and at least one operating parameter of the coil which varies as a function of the actual intensity of the magnetic field, in particular the magnetic saturation, is measured by the measuring means.

17. A thread feed device according to claim 15, wherein a core of high permeability is located in the coil.

18. A thread-delivery device having a storage body on which thread turns of a thread fed at one end in circumferential direction are deposited and from which the thread is withdrawn in axial direction, (overhead), the storage body having an outer surface in the shape of a drum upon which turns of the thread are displaced during a feeding of the thread, the device comprising a scanning device adjacent the storage body for scanning the thread turns as the thread turns are displaced from one end of the drum to the other;

wherein said scanning device comprises a swing arm which extends over a thread storage region of the storage body, a stationary sensor part positioned in fixed relation to the storage body, a light source disposed on the stationary part and providing a light beam, and a movable sensor part carried by the swing arm, the swing arm being swingable towards and away from the storage body;

the storage body has a feed-side end region, the swing arm is mounted in the thread feed-side end region of he storage body, the swing arm has a free end extending in a direction of displacement of the thread turns, there being in all positions of swing of the swing arm an inclined attitude with respect to the outer surface of the storage body, the swing arm being covered with wound turns of the thread;

the thread delivery device further comprises force means for exerting a restoring force against the swing arm, the position of swing being determined against the restoring force by a deposit of a first of the wound thread turns to control the position of the movable sensor part;

means for winding thread on said storage body, and mans coupled to said winding means for varying a winding speed;

said moveable sensor part cooperates with the stationary sensor part to provide at the stationary sensor part a sensor signal indicative of the position of the moveable sensor part, said speed varying means being responsive to said sensor signal to attain a reduction in a thread winding speed corresponding to an increasing covering of the length of the swing arm with thread turns;

the moveable sensor part comprises a reflection area arranged on the free end of the swing arm to serve as a mirror for deflecting the light beam, and the stationary sensor part comprises a light beam detector arranged outside the storage body, the thread winding speed being varied corresponding to a shift in location of a light beam impingement point on the light beam detector caused by a swing arm movement.

19. A thread feed device according to claim 18, further comprises a transport device arranged in the storage body;

wherein the turns of thread are deposited at a distance apart on the storage body, and the transport device transports turns of thread forward.

20. A thread feed device according to claim 1, further comprising a transport device arranged in the storage body;

wherein the turns of thread are deposited at a distance apart on the storage body, and the transport device transports turns of thread forward.

21. A thread feed device according to claim 1, wherein there is a point of emergence of a fully outwardly swung swing arm from the outer surface of the storage body; and a minimum thread storage region for reception of at least a few turns of thread is provided on the storage body at an entrance side in front of the point of emergence of a fully outwardly swung swing arm from the outer surface of the storage body.

22. A thread feed device according to claim 1, further comprising an analyzer of an analog signal, wherein an analog signal is outputted by the scanning device and is evaluated by said analyzer in fine steps, wherein for each turn of thread deposited on the swing arm, the turn of thread effects in each case a difference in a rotary-drive/driver-signal level.

23. A thread feed device according to claim 22, wherein the signal produced by the scanning device is electronically corrected for distortion by the scanning device allowing an electric voltage to be approximately proportional to the number of thread loops deposited.

24. A thread feed device according to claim 22, wherein said winding means includes a rotary drive for feeding the thread; and said varying means serves as a control device to which the analog output signal of the scanning device is fed, and which produces an output signal to control the rotary drive.

25. A thread feed device according to claim 24, wherein said control device has a proportional part providing an amplitude stroke which is about 10% to 20% of a control signal for full control of the rotary drive.

26. A thread feed device according to claim 24, further comprising a voltage/frequency converter which converts the output signal of the scanning device or of a subsequent control device into a signal of variable frequency.

27. A thread feed device according to claim 26, further comprising a logic circuit, which controls a pulse-duty factor or chopping frequency of signals fed to the rotary drive corresponding to a frequency of the output signal of the voltage/frequency converter.

28. A thread feed device according to claim 27, wherein the rotary drive is operative in response to driver signals; and the logic circuit controls the driver signals fed to the rotary drive to maintain a ratio between driver-signal voltage and driver-signal frequency substantially constant.

29. A thread feed device according to claim 28, wherein upon a decrease of the supply of thread to a minimum value, the logic circuit orders a maximum speed of rotation of the rotary drive, the rotary drive being stopped by the logic circuit upon attainment of the maximum thread supply.

30. A thread feed device according to claim 28, wherein upon activation of the thread feed device, the logic circuit sets a predetermined speed of rotation of the rotary drive.

31. A thread feed device according to claim 30, wherein the predetermined speed of rotation is about $\frac{1}{4}$ of a maximum speed of rotation.

32. A thread feed device according to claim 1, further comprising in the region of openings of the storage body, transport fingers for a spaced shifting of several thread turns, the transport fingers having thread-feed side ends, a top of the swing arm emerging from the outer surface of the storage body on a thread draw-off side of the thread-feed side ends of the transport fingers.

33. A thread feed device according to claim 1, further comprising on a thread feed side, a thread brake to brake the thread with a preferably adjustable braking force.

* * * * *